US005609033A

United States Patent [19]

Dong

[11] Patent Number: 5,609,033

[45] Date of Patent: Mar. 11, 1997

[54] WATER COOLING DEVICE FOR WATER PURIFIERS

[75] Inventor: Joung W. Dong, Seoul, Rep. of Korea

[73] Assignee: Chung Ho NAIS Incorporation, Seoul, Rep. of Korea

[21] Appl. No.: 585,446

[22] Filed: Jan. 16, 1996

[51] Int. Cl.[6] ..... F25B 21/02; F28D 5/00

[52] U.S. Cl. ..... 62/3.64; 62/3.7; 62/305

[58] Field of Search ..... 62/3.2, 3.6, 3.64, 62/3.7, 3.4, 305

[56] References Cited

U.S. PATENT DOCUMENTS

| | | | |
|---|---|---|---|
| 2,009,882 | 7/1935 | Fourness | 62/305 |
| 2,145,776 | 1/1939 | Muffly | 62/305 |
| 2,181,354 | 11/1939 | Winters | 62/305 |
| 2,931,188 | 4/1960 | Levit | 62/3.64 |
| 3,008,299 | 11/1961 | Scheckler | 62/3.64 |
| 3,250,433 | 5/1966 | Christine | 62/3.64 |
| 3,269,875 | 8/1966 | White | 62/3.2 |

*Primary Examiner*—William Doerrler
*Attorney, Agent, or Firm*—Harrison & Egbert

[57] ABSTRACT

A water cooling device for water purifiers is disclosed. In the above cooling device, the hot junction of a thermoelement compositely dissipate heat due to both latent heat of vaporization generated by water vaporization and air current blown by a blower fan, thereby cooling the purified water contained in the cold water tank more rapidly. The above thermoelement absorbs heat from the cold water tank at its cold junction and dissipates the heat to atmosphere at its hot junction. The above hot junction has a plurality of radiating fins which is covered with a zigzagged cooling water absorbing member saturated with cooling water. The cooling water is heated and vaporized by the heat of the hot junction thereby cooling the hot junction. The above radiating fins and zigzagged water absorbing member are clipped together by a clip unit in order to be brought into close contact with each other.

4 Claims, 3 Drawing Sheets

WATER COOLING DEVICE FOR WATER PURIFIERS

BACKGROUND OF THE INVENTION

1. Field of the Invention

The present invention relates in general to a water cooling device for water purifiers and, more particularly, to a structural improvement in such a cooling device for more cooling purified water contained in the cold water tank of a water purifier more rapidly. The above structural improvement is achieved by cooling the hot junction of a thermoelement coupled to the cold water tank by water and air, thereby promoting heat dissipation of the hot junction by both latent heat of vaporization and air current.

2. Description of the Prior Art

Typical water purifiers are not provided with means for cooling purified water. In this regard, the purified water of a typical water purifier is preserved in a refrigerator in order to be cooled prior to being distributed to users for drinking. This particularly true in the summer season. In addition, it has been noted that hexagonal water having a hexagonal molecular structure is good for one's health. Therefore, purified water has been recently required to be cooled regardless of the season as this water becomes healthful hexagonal water when it is cooled. However, as typical water purifiers are not provided with the purified water cooling means as described above, typical water purifiers cannot directly give cold water to users and thereby reduce their operational efficiency.

In an effort to rectify the above problems, Korean Patent Appln. No. 94-25892 applied by the applicant of this invention discloses a water purifier which has such a function for cooling a part of the purified water. In accordance with the above Korean water purifier, users selectively drink either normal temperature purified water or cold purified water as desired.

SUMMARY OF THE INVENTION

The present invention is for improving the structure of the above Korean water purifier.

It is, therefore, an object of the present invention to provide a water cooling device for water purifiers which causes a thermoelement mounted to a cold water tank to compositely dissipate heat due to both the latent heat of vaporization generated by water vaporization and the air current blown by a blower fan, thereby cooling the purified water contained in the cold water tank more rapidly.

In order to accomplish the above object, a water cooling device for water purifiers comprising a cold water tank for containing purified water and a thermoelement for absorbing heat from the cold water tank at its cold junction and dissipating the heat to the atmosphere at its hot junction, further comprising: a cool water absorbing member covering the hot junction and adapted for absorbing cooling water in order to be saturated with the cooling water, the cooling water of the above member being heated and vaporized by the heat of the hot junction thereby cooling the hot junction; and a cooling water supplying unit for continuously supplying cooling water to the water absorbing member.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
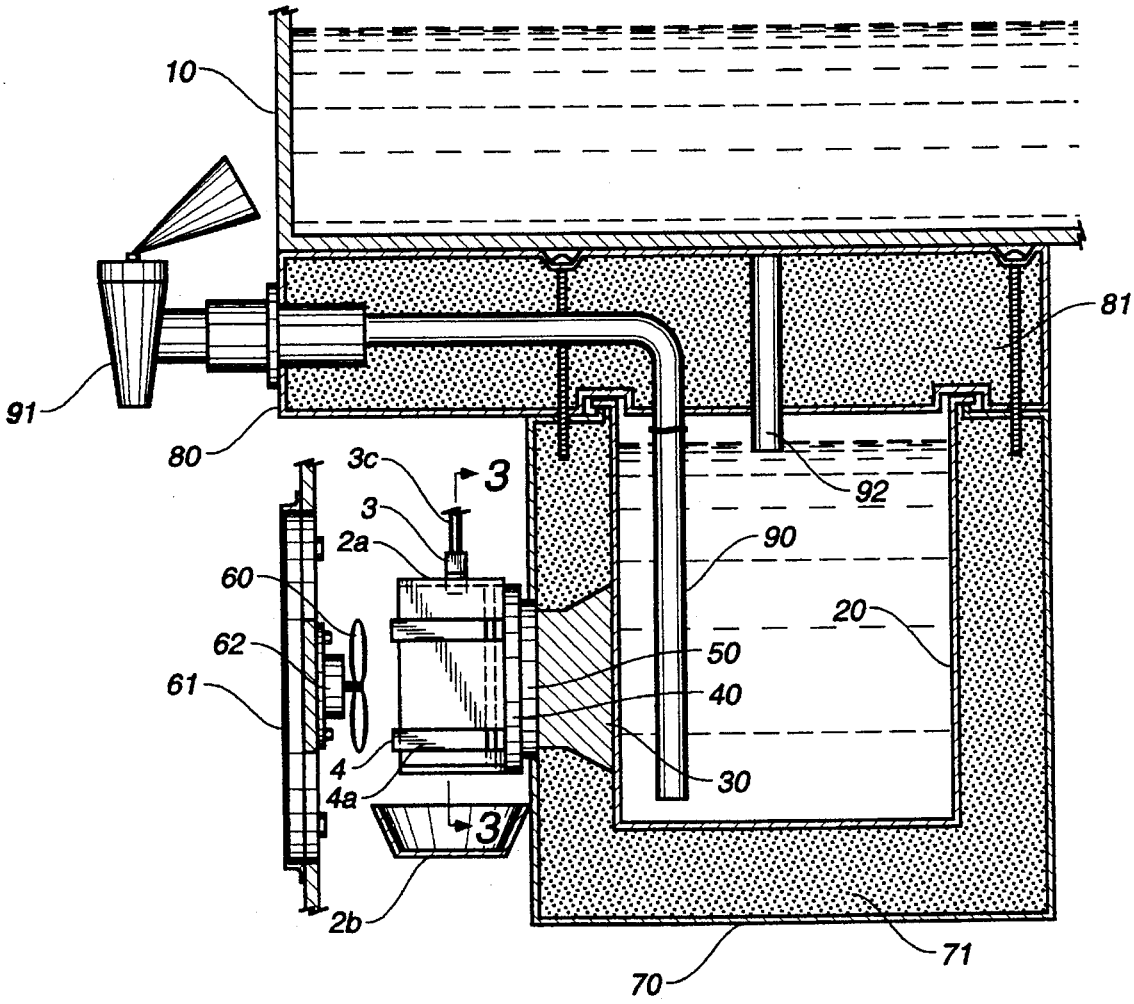
FIG. 1 is a sectional view of a water purifier provided with a water cooling device in accordance with a preferred embodiment of the present invention.

FIG. 1 is a sectional view of a water purifier provided with a water cooling device in accordance with a preferred embodiment of the present invention. As shown in the drawing, the water purifier includes a room water tank 10 which contains room temperature purified water coming out of a water purification system (not shown) of the water purifier. A cold water tank 20 is connected to the bottom of the above room water tank 10 through a connection pipe 92. The above cold water tank 20 is supplied with the normal temperature purified water from the normal water tank 10 in order to cool the purified water thereby forming cold purified water. The above cold water tank 20 is surrounded by an insulating outer casing 70 which is filled with a thermal insulating material 71. In addition, the top of the cold water tank 20 is covered with an insulating cover 80 which is filled with the same thermal insulating material 71. The water cooling device for the water purifier of this invention includes a thermoelement 40 which is mounted to a side wall of the outer casing 70. The above thermoelement 40 has an N-P type semiconductor. The above thermoelement 40 is coupled to the cold water tank 20 through a cold junction 30, thereby absorbing heat from the cold water tank 20 at the cold junction 30 and dissipating the heat to the surroundings at a hot junction 50. The above thermoelement 40 thus cools the purified water contained in the cold water tank 20.

The cold junction 30 of the above thermoelement 40 is brought into direct contact with the side wall of the cold water tank 20, thus absorbing heat from the tank 20. The above thermoelement 40 also includes the hot junction 50. The hot junction 50 is exposed to the atmosphere in order to dissipate the absorbed heat to the atmosphere. In the present invention, it is preferable to form both the cold water tank 20 and the cold junction 30 using aluminum having an excellent thermal conductivity. In addition, the hot junction 50 includes a plurality of radiating fins 51 in order to enlarge its heat dissipating surface and rapidly dissipate the heat to the atmosphere. The above water cooling device also includes a blower fan 60 which is driven by a motor 62. Due to the blower fan 60, the hot junction 50 is air-cooled. That is, the above blower fan 60 is directed toward the radiating fins 51 of the hot junction 50, thereby blowing air on the fins 51 in order to cool the radiating fins 51 by the air. The above hot junction 50 is also water-cooled. That is, a cooling water circulating means 1 is provided in the hot junction 50 of the thermoelement 40, thereby cooling the radiating fins 51 of the hot junction 50 with cooling water. The above cooling water circulating means 1 thus cooperates with the blower fan 60 to promote heat dissipation of the hot junction 50.

Figure 2:
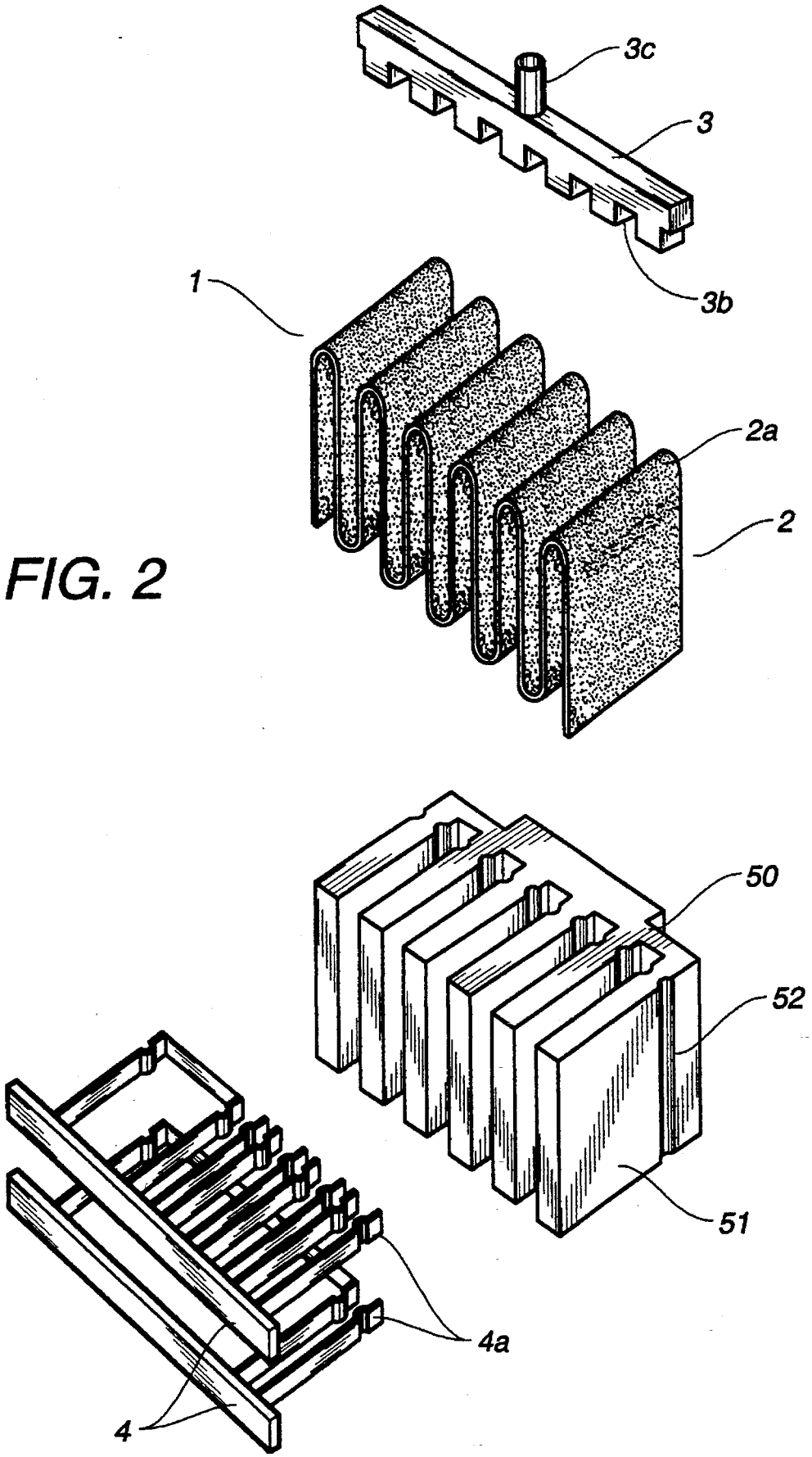
FIG. 2 is an exploded perspective view of the water cooling device for water purifiers of the present invention.

FIG. 2 is an exploded perspective view of the above water cooling device of the present invention. As shown in the drawing, the cooling water circulating means 1 includes a zigzag-type cooling water absorbing member 2 which has good water absorbency. The above zigzag-type absorbing member 2 has a plurality of bent portions 2*a*. The above cooling water circulating means 1 also includes a clip unit 4 which clips the zigzag-type water absorbing member 2 and radiating fins 51 together thereby allowing the water absorbing member 2 to come into close contact with the radiating fins 51. The cooling water circulating means 1 further includes a water supplying unit 3 which supplies cooling water to the water absorbing member 2.

The above cooling water absorbing member 2 absorbs the cooling water from the water supplying unit 3 in order to be saturated with cooling water. The water absorbing member 2 is generally made of fabrics and is fitted down over the dissipating fins 51 of the hot junction 50 from the top. The above clip unit 4 includes a plurality of pairs of pressing arms 4*a*. The above pressing arms 4*a* are arranged in two rows, that is, upper and lower rows, such that two pairs of pressing arms 4*a* corresponding to each radiating fin 51 vertically face each other. The pressing arms 4*a* of the clip unit 4 are elastically fitted over the radiating fins 51 covered with the zigzag-type member 2. The rear portion of each radiating fin 51 is provided with a pair of vertical grooves 52 on its opposite sides, thereby elastically engaging with the pressing arms 4*a*.

Figure 3:
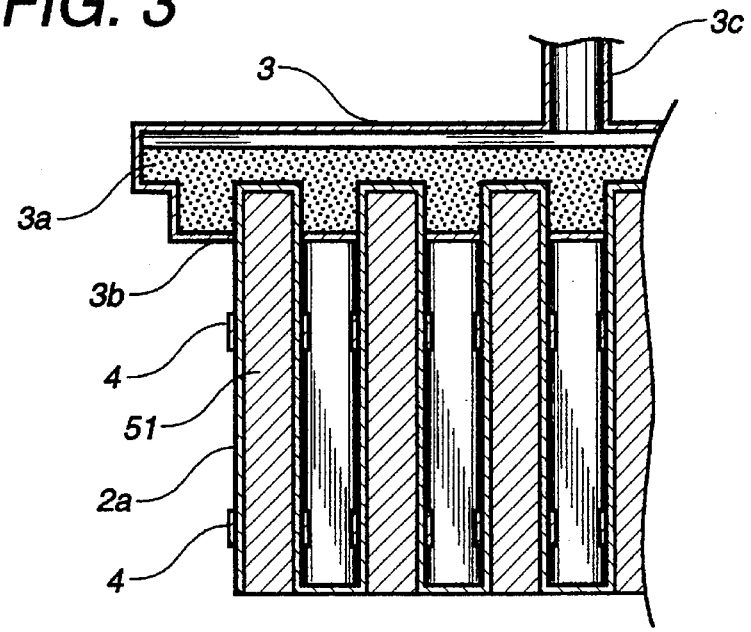
FIG. 3 is a sectional view of the water cooling device of the present invention taken along the section line A—A of FIG. 1.

FIG. 3 is a sectional view of the above water cooling device taken along the section line A—A of FIG. 1. As shown in the drawing, the water supplying unit 3 comprises a hollow horizontal pipe body which is provided with a plurality of fitting slots 3*b* on its bottom. The above fitting slots 3*b* tightly receive the top bent portions 2*a* of the zigzag-type water absorbing member 2 respectively. A water inlet pipe 3*c* extends from the top center of the above hollow pipe body of the water supplying unit 3. Placed in the above hollow pipe body of the water supplying unit 3 is a water absorbing material 3*a* which is saturated with cooling water. The water absorbing material 3*a* is exposed to the fitting slots 3*b*. Therefore, the above water absorbing material 3*a* is brought into contact with the water absorbing member 2 when the top bent portions 2*a* of the above member 2 are fitted into the fitting slots 3*b*. In the above state, the cooling water saturated in the water absorbing material 3*a* is absorbed by the water absorbing member 2. In the present invention, it is preferable to use a sponge, having good formability and water absorbency, as the water absorbing material 3*a*.

In the drawings, the reference numeral 91 denotes a cold water serving cock 91 which is connected to a water pipe 90 extending from the cold water tank 20, thereby selectively distributing the cold purified water to users for drinking. The numeral 61 denotes an air filter for filtering the cooling air sucked into the water purifier by the blowing force of the fan 60. The numeral 2*b* denotes a water pan which is placed under the hot junction 50 of the thermoelement 40 in order to collect water dropped from the water absorbing member 2.

In order to assemble the above elements into the water cooling device of the present invention, the water absorbing member 2 covers the radiating fins 51 of the hot junction 2. In the above state, the zigzag-type member 2 is fitted down on the radiating fins 51 from the top. Thereafter, the pressing arms 4*a* of the clip unit 4 are elastically fitted over the radiating fins 51 covered with the zigzag-type member 2. In the above case, the pressing arms 4*a* of the clip unit 4 engage with the vertical grooves 52 formed on both sides of the radiating fins 51, thereby causing the zigzag-type water absorbing member 2 to come into close contact with the radiating fins 51. The pressing arms 4*a* of the above clip unit 4 are tightly fitted over the upper and lower portions of the zigzag-type water absorbing member 2, thus to stably hold the member 2 over the radiating fins 51. Thereafter, the cooling water supplying unit 3 engages with the zigzag-type member 2 by fitting the top bent portions 2*a* of the member 2 into the fitting slots 3*b* of the water supplying unit 3 respectively.

After assembling the elements into the water cooling device as described above, the cooling water is supplied to the water absorbing materials 3*a* of the unit 3 through the water inlet pipe 3*c*. The water absorbing materials 3*a* is thus saturated with cooling water.

As the water absorbing materials 3*a* saturated with the cooling water comes into contact with the top bent portions 2*a* of the water absorbing member 2 at the fitting slots 3*b* as described above, the cooling water of the water absorbing material 3*a* is absorbed by the water absorbing member 2. The water absorbing member 2 is thus saturated with cooling water. The radiating fins 51 of the hot junction 50 are wet by the cooling water saturated in the water absorbing member 2.

When the water purifier is turned on, the water purification system purifies fresh water thereby forming purified water. The purified water is introduced into the normal water tank 10 and in turn introduced into the cold water tank 20 through the connection pipe 92. When the thermoelement 40 of the water cooling device is turned on in order to cool the purified water in the cold water tank 20, the thermoelement 40 absorbs heat from the cold water tank 20 and dissipates the heat to the atmosphere. In the above case, the cold junction 30 of the thermoelement 40 absorbs the heat from the cold water tank 20 thereby cooling the purified water contained in the tank 20. The absorbed heat is transmitted to the hot junction 50 of the thermoelement 40. The hot junction 50 dissipates the heat to the atmosphere.

The above hot junction 50 in the above state is heated as its dissipates the absorbed heat. Therefore, the cooling water saturated in the water absorbing member 2 is heated by the hot junction 50, thereby being vaporized and generating latent heat of vaporization. The above latent heat of vaporization is generated from the member 2 when the cooling water saturated in the members 2 is vaporized due to the heat absorbed from the radiating fins 51 of the hot junction 50. The above latent heat of vaporization causes the radiating fins 51 to momentarily dissipate the heat to the atmosphere. In addition, the radiating fins 51 are also air-cooled. That is, the blower fan 60 is driven by the rotating force of the motor 62 thereby blowing cooling air on the fins 51. Vaporization of the water of the member 2 is thus promoted to cause the radiating fins 51 to dissipate the heat to the atmosphere more rapidly.

Figure 4:
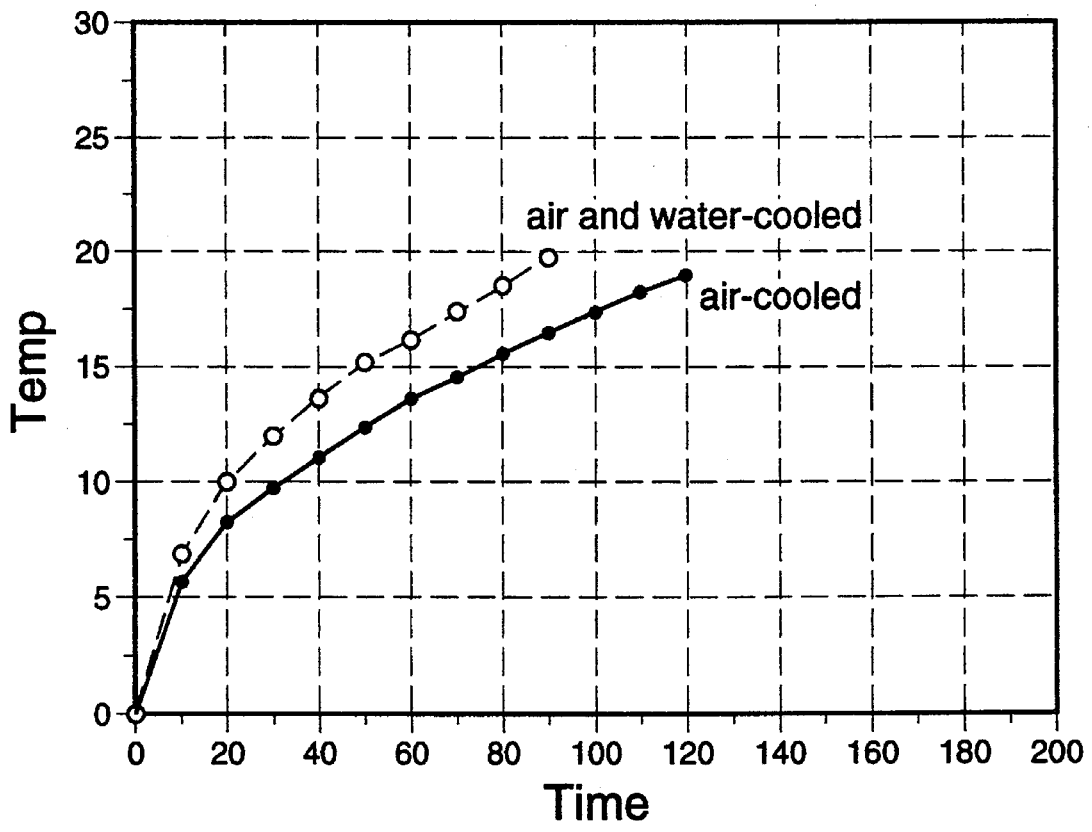
FIG. 4 is a graph showing a temperature difference between the room temperature water tank and cold water tank of the water purifier provided with the water cooling device of the present invention.

FIG. 4 is a graph showing the temperature difference between the normal temperature and cold water tanks of the water purifier provided with the purified water cooling device of the present invention. As shown in the graph, the temperature difference between the normal and cold water tanks 10 and 20 after the lapse of 90 minutes when the hot junction 50 is exclusively air-cooled by the blower fan 60 is 16°. However, when the hot junction 50 is water-cooled by the water saturated in the water absorbing member 2 and air-cooled by the blower fan 60, the temperature difference between the normal and cold water tanks 10 and 20 is 20°. Therefore, it is noted that the cold water tank 20 is cooled more rapidly when the hot junction 50 is water-cooled and air-cooled than when the junction 50 is exclusively air-cooled. That is, when the hot junction 50 of the water cooling device is compositely cooled by the water of the member 2 and the air of the blower fan 60, the hot junction 50 dissipates heat to the atmosphere more rapidly in order to cool the cold water tank 20 more rapidly. The water cooling device in the above state cools the purified water contained in the cold water tank 20 more rapidly.

As described above, the present invention provides a structurally improved water cooling device for water purifiers. In accordance with the above water cooling device, the cold junction of a thermoelement absorbs heat from the purified water contained in a cold water tank, thereby forming cold purified water. The absorbed heat is transmitted to the hot junction in order to be dissipated to the atmosphere therefrom. In accordance with the present invention, the above hot junction is covered with a water absorbing member saturated with cooling water. The cooling water saturated in the above water absorbing member is heated and vaporized by the heat of the hot junction, thus generating latent heat of vaporization. Due to the latent heat of vaporization, the hot junction momentarily dissipates the absorbed heat to the atmosphere. The water cooling device of this invention also includes a blower fan which blows air on the hot junction covered with the water absorbing member. The blower fan thus promotes heat dissipation of the hot junction. In this regard, the water cooling device for water purifiers cools the purified water contained in the cold water tank more rapidly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A water cooling device for water purifiers comprising a cold water tank for containing purified water and a thermoelement for absorbing heat from the cold water tank at its cold junction and dissipating the heat to atmosphere at its hot junction, further comprising:

a cooling water absorbing member covering said hot junction and adapted for absorbing cooling water in order to be saturated with the cooling water, the cooled water saturated in the water absorbing member being heated and vaporized by the heat of said hot junction thereby cooling the hot junction;

a cooling water supplying unit adapted for continuously supplying cooling water to said cooling water absorbing member, wherein said hot junction is provided with a plurality of radiating fins exposed to the atmosphere, and said cooling water absorbing member being bent into a plurality of zigzag-shaped bent portions fitted over said radiating fins;

a clip unit for clipping the radiating fins and zigzagged water absorbing member together in order to cause the zigzagged water absorbing member to come into close contact with said radiating fins, said clip unit having a plurality of pressing arms elastically engaging with the radiating fins covered with the water absorbing member; and a plurality of vertical grooves formed on rear portions of said radiating fins and adapted for elastically engaging with tip portions of said pressing arms of the clip unit.

2. The water cooling device according to claim 1, wherein said cooling water absorbing member is made of fabrics having an excellent water absorbency.

3. The water cooling device according to claim 1, further comprising a blower fan adapted for blowing air on said cooling water absorbing member thereby promoting vaporization of the cooling water.

4. A water cooling device for water purifiers comprising a cold water tank for containing purified water and a thermoelement for absorbing heat from the cold water tank at its cold junction and dissipating the heat to atmosphere at its hot junction, further comprising:

a cooling water absorbing member covering said hot junction and adapted for absorbing cooling water in order to be saturated with the cooling water, the cooled water saturated in the water absorbing member being heated and vaporized by the heat of said hot junction thereby cooling the hot junction; and a cooling water supplying unit adapted for continuously supplying cooling water to said cooling water absorbing member, wherein said hot junction is provided with a plurality of radiating fins exposed to the atmosphere, and said cooling water absorbing member being bent into a plurality of zigzag-shaped bent portions fitted over said radiating fins, said cooling water supplying unit comprising:

a hollow horizontal pipe body provided with a plurality of fitting slots on its bottom, said fitting slots tightly receiving a plurality of top bent portions of said zigzagged water absorbing member respectively;

a cooling water absorbing material provided in said pipe body, said water absorbing material having an excellent water absorbency and being brought into contact with said cooling water absorbing member at said fitting slots; and a cooling water inlet pipe extending from a top center of said pipe body and adapted for supplying cooling water to said water absorbing material in the pipe body.

* * * * *